US008376192B2

(12) United States Patent
Maddy

(10) Patent No.: US 8,376,192 B2
(45) Date of Patent: Feb. 19, 2013

(54) APPARATUS FOR DISPENSING FLUIDS USING A PRESS-FIT DIPTUBE

(75) Inventor: Tim Maddy, Dallas, TX (US)

(73) Assignee: Mary Kay Inc., Dallas, TX (US)

( * ) Notice: Subject to any disclaimer, the term of this patent is extended or adjusted under 35 U.S.C. 154(b) by 838 days.

(21) Appl. No.: 12/054,108

(22) Filed: Mar. 24, 2008

(65) Prior Publication Data

US 2009/0236372 A1 Sep. 24, 2009

(51) Int. Cl.
*B67D 7/78* (2010.01)

(52) U.S. Cl. ..... 222/382; 222/464.1; 239/333

(58) Field of Classification Search ..... 222/372, 222/382, 383.1, 211, 321.1–321.9, 385, 464.1, 222/542, 153.09–153.1; 220/320; 215/273–274; 239/333

See application file for complete search history.

(56) References Cited

U.S. PATENT DOCUMENTS

| | | | | |
|---|---|---|---|---|
| 2,861,839 | A * | 11/1958 | Mellon | 222/321.9 |
| D196,393 | S | 9/1963 | Sanders, Jr. et al. | D9/448 |
| 3,254,803 | A | 6/1966 | Meshberz | 222/182 |
| 3,276,641 | A | 10/1966 | Lehmann | 222/526 |
| 3,325,054 | A | 6/1967 | Braun | 222/39 |
| 3,422,996 | A | 1/1969 | Lipman | 222/402.11 |
| 3,474,939 | A | 10/1969 | O'Donnell et al. | 222/320 |
| 3,484,023 | A | 12/1969 | Meshberg | 222/402.11 |
| 3,591,128 | A | 7/1971 | Ramis | 251/100 |
| 3,598,290 | A | 8/1971 | Steiman | 222/94 |
| 3,603,454 | A | 9/1971 | Raaf | 206/47 |
| 3,613,960 | A | 10/1971 | Beard | 222/330 |
| 3,622,052 | A | 11/1971 | Gach | 222/402.11 |
| 3,658,215 | A | 4/1972 | Ewald | 222/402.18 |
| 3,705,668 | A | 12/1972 | Schwartzman | 222/211 |
| 3,707,875 | A | 1/1973 | Freeman | 73/423 |
| 3,722,750 | A | 3/1973 | Fox, Jr. | 222/136 |
| 3,724,723 | A | 4/1973 | Slavinski | 222/110 |
| 3,729,119 | A | 4/1973 | Sette et al. | 222/153.11 |
| 3,797,705 | A | 3/1974 | Cooprider | 222/153.13 |
| 3,848,778 | A | 11/1974 | Meshberg | 222/402.11 |
| 3,851,799 | A | 12/1974 | Paoletti | 222/145 |
| 3,869,070 | A | 3/1975 | Schmoegner et al. | 222/193 |
| 3,894,665 | A | 7/1975 | Swenson | 222/402.11 |
| 3,933,283 | A | 1/1976 | Hoagland | 222/402.13 |

(Continued)

FOREIGN PATENT DOCUMENTS

| | | |
|---|---|---|
| EP | 1 317 964 | 6/2003 |
| EP | 1 389 491 | 2/2004 |

(Continued)

OTHER PUBLICATIONS

"Aerosols for apprentices; cosmetics manufacturing," *Cosmetics and Toiletries*, 111(5):35, 1996.

(Continued)

*Primary Examiner* — Kevin P Shaver
*Assistant Examiner* — Andrew P Bainbridge
(74) *Attorney, Agent, or Firm* — Fulbright & Jaworski L.L.P.

(57) ABSTRACT

Apparatuses suited for use with, for example, fluid cosmetic products. In some embodiments, the present apparatuses include a container and a diptube having a diptube plug and a stem. In these embodiments, the diptube plug has a first press-fit surface, and the diptube is removably coupled to the container by a press fit between the first press-fit surface of the diptube plug and the container mouth.

19 Claims, 5 Drawing Sheets

U.S. PATENT DOCUMENTS

| | | | | | |
|---|---|---|---|---|---|
| 3,973,701 | A | | 8/1976 | Gardner | 222/190 |
| 4,010,874 | A | | 3/1977 | Steiman | 222/321.3 |
| 4,057,176 | A | | 11/1977 | Horvath | 222/175 |
| 4,065,036 | A | | 12/1977 | Kirk, Jr. | 222/153.13 |
| 4,071,172 | A | | 1/1978 | Balogh | 222/321.7 |
| 4,087,025 | A | | 5/1978 | Steiman | 222/321.9 |
| 4,122,979 | A | | 10/1978 | Laauwe | 222/633 |
| 4,142,652 | A | | 3/1979 | Platt | 222/402.2 |
| 4,147,306 | A | | 4/1979 | Bennett | 239/327 |
| 4,155,489 | A | | 5/1979 | Steiman | 222/321.9 |
| 4,156,505 | A | | 5/1979 | Bennett | 239/327 |
| 4,162,746 | A | | 7/1979 | Anderson et al. | 222/153.13 |
| 4,173,297 | A | | 11/1979 | Pettersen | 222/321.2 |
| 4,174,056 | A | * | 11/1979 | Loeffler | 222/321.8 |
| 4,184,615 | A | | 1/1980 | Wright | 222/190 |
| 4,193,514 | A | | 3/1980 | Langstroth | 222/4 |
| 4,203,552 | A | | 5/1980 | Hayes | 239/337 |
| 4,212,332 | A | | 7/1980 | Kutik et al. | 141/98 |
| 4,223,842 | A | | 9/1980 | Hayes | 239/327 |
| 4,226,367 | A | | 10/1980 | Hayes | 239/327 |
| 4,265,373 | A | | 5/1981 | Stoody | 222/94 |
| 4,265,375 | A | | 5/1981 | Flider | 222/189.01 |
| 4,274,560 | A | | 6/1981 | Cater | 222/321.2 |
| 4,278,189 | A | | 7/1981 | Kirk | 222/321.2 |
| D260,605 | S | | 9/1981 | Saunders | D9/686 |
| 4,286,636 | A | | 9/1981 | Credle | 141/114 |
| 4,294,293 | A | | 10/1981 | Lorenz et al. | 141/100 |
| 4,311,255 | A | | 1/1982 | Meshberg | 222/183 |
| 4,324,351 | A | | 4/1982 | Meshberg | 222/402.11 |
| 4,327,782 | A | | 5/1982 | McKibben et al. | 141/26 |
| D265,459 | S | | 7/1982 | Picot | D9/686 |
| 4,343,417 | A | | 8/1982 | Corsette | 222/153.13 |
| 4,354,621 | A | | 10/1982 | Knickerbocker | 222/47 |
| 4,370,989 | A | | 2/1983 | Taylor | 132/317 |
| 4,398,654 | A | | 8/1983 | Pong et al. | 222/402.1 |
| 4,401,270 | A | | 8/1983 | McKinney | 239/327 |
| D270,863 | S | | 10/1983 | Martinez | D28/91.1 |
| D270,864 | S | | 10/1983 | Martinez | D28/91.1 |
| D270,956 | S | | 10/1983 | Martinez | D28/91.1 |
| 4,410,107 | A | | 10/1983 | Corsette | 222/321.7 |
| D271,243 | S | | 11/1983 | Martinez | D28/91.1 |
| D271,244 | S | | 11/1983 | Martinez | D28/91.1 |
| D271,245 | S | | 11/1983 | Martinez | D28/91.1 |
| 4,418,846 | A | | 12/1983 | Pong et al. | 222/189.1 |
| 4,420,098 | A | | 12/1983 | Bennett | 222/190 |
| D272,045 | S | | 1/1984 | Parr | D9/690 |
| 4,433,799 | A | | 2/1984 | Corsette | 222/309 |
| 4,434,914 | A | | 3/1984 | Meshberg | 222/153.11 |
| 4,435,135 | A | | 3/1984 | Knickerbocker | 417/511 |
| 4,437,588 | A | | 3/1984 | Shay | 222/321.2 |
| 4,445,539 | A | | 5/1984 | Credle | 137/614.03 |
| 4,454,966 | A | | 6/1984 | Hicks | 222/153.11 |
| 4,458,832 | A | | 7/1984 | Corsette | 222/153.13 |
| 4,475,667 | A | | 10/1984 | Ori et al. | 222/39 |
| D277,549 | S | | 2/1985 | Martinez | D9/687 |
| 4,506,808 | A | | 3/1985 | Goncalves | 222/182 |
| 4,511,064 | A | | 4/1985 | Ruscitti et al. | 222/153.06 |
| 4,513,890 | A | | 4/1985 | Goncalves | 222/153.06 |
| 4,513,891 | A | | 4/1985 | Hain et al. | 222/213 |
| 4,526,302 | A | | 7/1985 | Brunet | 222/321.7 |
| 4,549,674 | A | | 10/1985 | Alticosalian | 222/48 |
| 4,572,406 | A | | 2/1986 | Pratt et al. | 222/39 |
| 4,572,410 | A | | 2/1986 | Brunet | 222/402.11 |
| 4,620,646 | A | | 11/1986 | Crapser | 222/153.11 |
| D288,491 | S | | 2/1987 | Speitel | D28/91.1 |
| 4,671,330 | A | | 6/1987 | Miles | 141/24 |
| 4,676,408 | A | | 6/1987 | Speitel | 222/183 |
| 4,678,101 | A | | 7/1987 | Nitchman et al. | 222/82 |
| 4,679,712 | A | | 7/1987 | Foster et al. | 222/384 |
| 4,680,173 | A | | 7/1987 | Burger | 424/47 |
| D291,972 | S | | 9/1987 | Pfeiffer | D9/448 |
| D292,066 | S | | 9/1987 | Rodriguez Gazulla | D9/687 |
| D292,265 | S | | 10/1987 | Schmidt | D9/687 |
| 4,730,751 | A | | 3/1988 | Mackles et al. | 222/211 |
| D295,834 | S | | 5/1988 | Crapser | D9/686 |
| 4,770,323 | A | | 9/1988 | Debard | 222/82 |
| 4,773,567 | A | | 9/1988 | Stoody | 222/153.11 |
| 4,779,773 | A | | 10/1988 | Bennett | 222/507 |
| D299,694 | S | | 2/1989 | Geiger | D9/686 |
| 4,809,878 | A | | 3/1989 | Rainey | 222/321.9 |
| 4,836,423 | A | | 6/1989 | Hayes et al. | 222/257 |
| 4,850,517 | A | | 7/1989 | Ter Stege | 222/402.18 |
| 4,863,071 | A | | 9/1989 | Guss et al. | 222/207 |
| 4,865,228 | A | | 9/1989 | Landecker | 222/153.13 |
| 4,878,604 | A | | 11/1989 | Barriac | 222/209 |
| 4,889,262 | A | | 12/1989 | Toms | 222/153.13 |
| D306,554 | S | | 3/1990 | Lawson | D9/687 |
| D307,542 | S | | 5/1990 | De Montgailhard | D9/687 |
| D308,474 | S | | 6/1990 | Seager | D9/689 |
| 4,930,670 | A | | 6/1990 | Kuo | 222/321.3 |
| 4,961,727 | A | | 10/1990 | Beard | 604/75 |
| 4,979,638 | A | | 12/1990 | Bolduc | 222/1 |
| D314,688 | S | | 2/1991 | Guillerm | D9/448 |
| 4,998,649 | A | | 3/1991 | Thanisch | 222/507 |
| D316,959 | S | | 5/1991 | Battegazzore | D9/689 |
| 5,016,783 | A | | 5/1991 | Hayes et al. | 222/153.13 |
| 5,018,643 | A | | 5/1991 | Bolduc | 222/1 |
| D317,253 | S | | 6/1991 | Seager | D9/689 |
| D317,714 | S | | 6/1991 | Greubel | D9/687 |
| D319,967 | S | | 9/1991 | Battegazzore | D9/689 |
| 5,052,585 | A | | 10/1991 | Bolduc | 222/1 |
| 5,062,549 | A | | 11/1991 | Smith et al. | 222/377 |
| 5,090,601 | A | | 2/1992 | Thanisch | 222/507 |
| 5,097,867 | A | | 3/1992 | Frigiere et al. | 137/590 |
| 5,110,011 | A | | 5/1992 | Laska et al. | 222/82 |
| 5,120,438 | A | | 6/1992 | Nakagawa et al. | 210/256 |
| 5,123,571 | A | | 6/1992 | Rebeyrolle et al. | 222/105 |
| 5,127,553 | A | | 7/1992 | Weinstein | 222/158 |
| 5,143,288 | A | | 9/1992 | Kohler et al. | 239/1 |
| 5,180,084 | A | | 1/1993 | Favre | 222/192 |
| 5,183,186 | A | | 2/1993 | Delaney | 222/211 |
| 5,192,006 | A | | 3/1993 | Van Brocklin et al. | 222/321.9 |
| 5,222,633 | A | | 6/1993 | Blake | 222/179 |
| 5,222,636 | A | | 6/1993 | Meuresch | 222/321.4 |
| 5,244,128 | A | | 9/1993 | De Laforcade | 222/403.13 |
| 5,253,786 | A | | 10/1993 | Schmidt | 222/153.03 |
| D341,225 | S | | 11/1993 | Lang et al. | D28/76 |
| D344,231 | S | | 2/1994 | Gagnon | D9/686 |
| 5,301,846 | A | | 4/1994 | Schmitz | 222/211 |
| 5,301,852 | A | | 4/1994 | Mancini | 222/321.9 |
| 5,310,093 | A | | 5/1994 | Bennett | 222/190 |
| 5,314,093 | A | | 5/1994 | Gross et al. | 222/153.14 |
| 5,318,205 | A | | 6/1994 | Delaney, Jr. et al. | 222/211 |
| 5,323,933 | A | | 6/1994 | Brakarz et al. | 222/321 |
| 5,328,055 | A | | 7/1994 | Battle | 222/83.5 |
| 5,335,821 | A | | 8/1994 | Osgar | 222/83 |
| 5,348,194 | A | | 9/1994 | Mascitelli et al. | 222/209 |
| 5,358,037 | A | | 10/1994 | Edwards et al. | 166/105 |
| 5,366,118 | A | | 11/1994 | Ciammitti et al. | 222/153.1 |
| 5,379,924 | A | | 1/1995 | Taylor | 222/402.11 |
| 5,388,730 | A | | 2/1995 | Abbott et al. | 222/153.13 |
| 5,399,040 | A | | 3/1995 | Holloway | 401/78 |
| 5,409,136 | A | | 4/1995 | Workum | 222/1 |
| 5,435,460 | A | | 7/1995 | Osgar | 222/1 |
| 5,443,569 | A | | 8/1995 | Uehira et al. | 222/190 |
| 5,460,207 | A | | 10/1995 | Meshberg | 141/1 |
| 5,464,129 | A | | 11/1995 | Ho | 222/377 |
| D365,990 | S | | 1/1996 | McSwiggan et al. | D9/448 |
| 5,503,302 | A | | 4/1996 | DeJonge | 222/82 |
| 5,503,303 | A | | 4/1996 | LaWare et al. | 222/153.12 |
| 5,522,548 | A | | 6/1996 | Gallien et al. | 239/337 |
| 5,526,960 | A | | 6/1996 | Breidenbach et al. | 222/183 |
| 5,531,359 | A | | 7/1996 | Winner | 222/153.11 |
| D375,263 | S | | 11/1996 | Knickerbocker | D9/448 |
| 5,573,143 | A | | 11/1996 | Deardurff et al. | 222/153.14 |
| 5,586,694 | A | | 12/1996 | Breidenbach et al. | 222/183 |
| 5,590,815 | A | | 1/1997 | Montaner et al. | 222/82 |
| 5,593,064 | A | | 1/1997 | Meshberg | 22/39 |
| 5,595,326 | A | * | 1/1997 | Bougamont et al. | 222/321.7 |
| 5,620,113 | A | | 4/1997 | Meshberg | 222/1 |
| D381,261 | S | | 7/1997 | Crawford | D9/686 |
| 5,649,645 | A | | 7/1997 | Demarest et al. | 222/453.07 |
| 5,649,649 | A | | 7/1997 | Marelli | 222/321.2 |
| 5,649,777 | A | | 7/1997 | Holloway | 401/78 |
| 5,657,909 | A | | 8/1997 | Barriac | 222/382 |
| 5,657,910 | A | | 8/1997 | Keyser | 222/382 |
| 5,664,700 | A | | 9/1997 | Battle | 222/105 |

| | | | | |
|---|---|---|---|---|
| D388,320 | S | 12/1997 | Lamb | D9/688 |
| 5,725,128 | A | 3/1998 | Foster | 222/153.13 |
| 5,755,364 | A | 5/1998 | LeCoffre et al. | 222/564 |
| 5,762,322 | A | 6/1998 | Smith | 251/353 |
| 5,772,080 | A | 6/1998 | de Pous et al. | 222/321.7 |
| 5,772,083 | A | 6/1998 | Joulia | 222/396 |
| 5,788,119 | A | 8/1998 | Esclar et al. | 222/58 |
| 5,791,524 | A | 8/1998 | Demarest | 222/153.06 |
| 5,799,810 | A | 9/1998 | de Pous et al. | 215/274 |
| D399,745 | S | 10/1998 | Mascitelli | D9/448 |
| D400,784 | S | 11/1998 | Cummings et al. | D9/686 |
| D400,792 | S | 11/1998 | Mascitelli | D9/448 |
| D401,501 | S | 11/1998 | Nagayoshi | D9/688 |
| 5,832,965 | A | 11/1998 | Fasse et al. | 141/20 |
| 5,842,604 | A | 12/1998 | Stahley et al. | 222/95 |
| 5,850,947 | A | 12/1998 | Kim | 222/321.4 |
| D406,761 | S | 3/1999 | Garcia | D9/434 |
| 5,875,932 | A | 3/1999 | Meshberg | 222/153.13 |
| 5,875,933 | A | 3/1999 | Ellion et al. | 222/189.1 |
| 5,918,774 | A | 7/1999 | Lund et al. | 222/153.13 |
| 5,921,233 | A | 7/1999 | Gold et al. | 128/200.22 |
| 5,957,337 | A | 9/1999 | Bettison, Jr. | 222/153.11 |
| D414,697 | S | 10/1999 | Sayers | D9/448 |
| 5,967,377 | A | 10/1999 | Glynn | 222/158 |
| 5,971,230 | A | 10/1999 | Tanaka | 222/402.11 |
| 5,979,712 | A | 11/1999 | Montaner et al. | 222/321.4 |
| D419,433 | S | 1/2000 | Conway | D9/687 |
| 6,016,934 | A | 1/2000 | Moriguchi | 222/1 |
| D419,877 | S | 2/2000 | Sayers | D9/448 |
| 6,021,924 | A | 2/2000 | Suck et al. | 222/105 |
| 6,050,504 | A | 4/2000 | Schultz et al. | 239/327 |
| 6,053,363 | A | 4/2000 | Revenu | 222/82 |
| D425,407 | S | 5/2000 | Ackerman | D9/687 |
| 6,062,430 | A | 5/2000 | Fuchs | 222/105 |
| 6,065,647 | A | 5/2000 | Bliss, III et al. | 222/153.02 |
| D426,466 | S | 6/2000 | Nevins et al. | D9/529 |
| 6,076,708 | A | 6/2000 | Ceccarelli et al. | 222/189.1 |
| 6,085,927 | A | 7/2000 | Kusz | 220/23.87 |
| 6,119,897 | A | 9/2000 | Boileau | 222/78 |
| 6,126,042 | A | 10/2000 | Meshberg | 222/321.4 |
| 6,142,345 | A | 11/2000 | Laible | 222/189.1 |
| 6,186,369 | B1 | 2/2001 | Rosenthal | 222/321.7 |
| 6,186,372 | B1 | 2/2001 | Garcia et al. | 222/402.19 |
| 6,247,613 | B1 | 6/2001 | Meshberg | 222/1 |
| 6,264,073 | B1 | 7/2001 | Good et al. | 222/464.4 |
| 6,276,566 | B1 | 8/2001 | Zaksenberg | 222/78 |
| 6,279,786 | B1 * | 8/2001 | de Pous et al. | 222/321.9 |
| 6,283,335 | B1 | 9/2001 | Young et al. | 222/182 |
| 6,290,100 | B1 | 9/2001 | Yacko et al. | 222/129 |
| 6,302,302 | B1 | 10/2001 | Albisetti | 222/153.11 |
| D449,978 | S | 11/2001 | Viellard | D9/687 |
| 6,364,172 | B1 | 4/2002 | Maas et al. | 222/383.1 |
| 6,382,463 | B2 | 5/2002 | Meshberg | 222/1 |
| 6,398,133 | B1 | 6/2002 | Schultz | 239/327 |
| 6,427,870 | B2 | 8/2002 | De Laforcade | 222/1 |
| 6,435,376 | B1 | 8/2002 | Meshberg | 222/321.7 |
| D466,403 | S | 12/2002 | Haas et al. | D9/687 |
| D467,162 | S | 12/2002 | Viellard | D9/687 |
| 6,502,726 | B1 | 1/2003 | Yquel | 222/321.1 |
| 6,523,722 | B1 | 2/2003 | Clark et al. | 222/153.14 |
| D472,460 | S | 4/2003 | Garcia et al. | D9/687 |
| D473,457 | S | 4/2003 | Reinoso | D9/686 |
| 6,561,232 | B1 | 5/2003 | Frutin | 141/9 |
| 6,592,010 | B2 * | 7/2003 | Plessis | 222/321.9 |
| 6,601,735 | B2 | 8/2003 | Milian et al. | 222/153.11 |
| 6,612,468 | B2 | 9/2003 | Pritchett et al. | 222/190 |
| 6,622,931 | B2 | 9/2003 | Bonningue | 239/1 |
| 6,641,001 | B2 | 11/2003 | Beranger et al. | 222/321.9 |
| 6,644,511 | B2 | 11/2003 | Hsu et al. | 222/129 |
| 6,648,538 | B2 | 11/2003 | Gueret | 401/130 |
| 6,685,062 | B1 * | 2/2004 | Ki | 222/321.7 |
| 6,695,171 | B2 | 2/2004 | Walters et al. | 222/153.13 |
| 6,695,179 | B2 | 2/2004 | Mandile | 222/464.3 |
| 6,708,852 | B2 | 3/2004 | Blake | 222/321.5 |
| 6,739,481 | B2 | 5/2004 | Meshberg | 222/153.11 |
| D490,699 | S | 6/2004 | Nelson et al. | D9/689 |
| D491,456 | S | 6/2004 | Cagle | D9/687 |
| 6,742,677 | B2 | 6/2004 | Petit et al. | 222/321.7 |
| 6,758,373 | B2 | 7/2004 | Jackson et al. | 222/153.11 |
| 6,766,922 | B2 | 7/2004 | da Silva | 222/211 |
| 6,776,311 | B2 | 8/2004 | Ackermann | 222/321.7 |
| 6,779,693 | B2 | 8/2004 | Sweeton et al. | 222/464.4 |
| 6,799,690 | B2 | 10/2004 | De Pous et al. | 215/274 |
| D499,012 | S | 11/2004 | Illenberger et al. | D9/686 |
| 6,817,488 | B2 | 11/2004 | Meshberg | 222/153.11 |
| 6,832,704 | B2 | 12/2004 | Smith | 222/402.1 |
| 6,843,368 | B1 | 1/2005 | Frutin | 206/219 |
| 6,868,990 | B2 | 3/2005 | Cater et al. | 222/190 |
| D507,753 | S | 7/2005 | Lamb et al. | D9/689 |
| 6,932,244 | B2 | 8/2005 | Meshberg | 222/153.13 |
| 6,932,248 | B2 | 8/2005 | Fracasso | 222/522 |
| 6,935,540 | B2 | 8/2005 | Ackermann | 222/321.7 |
| 6,938,802 | B2 | 9/2005 | Petit | 222/321.7 |
| 6,945,419 | B2 | 9/2005 | Bertazza et al. | 220/23.87 |
| D511,302 | S | 11/2005 | Lamb et al. | D9/689 |
| 6,971,552 | B2 | 12/2005 | Meshberg | 222/153.13 |
| 6,978,916 | B2 | 12/2005 | Smith | 222/402.2 |
| 6,983,864 | B1 | 1/2006 | Cagle | 222/131 |
| 6,986,444 | B2 | 1/2006 | Fuchs | 222/321.9 |
| 7,011,236 | B2 * | 3/2006 | VanBrocklin | 222/321.9 |
| 7,011,237 | B1 | 3/2006 | Sayers et al. | 222/321.9 |
| 7,134,578 | B2 * | 11/2006 | Bougamont | 222/321.9 |
| 7,147,135 | B2 | 12/2006 | Le Maner | 222/321.9 |
| 7,163,125 | B2 | 1/2007 | Murakami et al. | 222/51 |
| 7,191,920 | B2 | 3/2007 | Boll et al. | 222/333 |
| 7,207,468 | B2 | 4/2007 | Cohen et al. | 222/321.9 |
| 7,222,755 | B2 | 5/2007 | Glynn et al. | 222/205 |
| 7,249,692 | B2 | 7/2007 | Walters et al. | 222/153.11 |
| 7,255,248 | B2 * | 8/2007 | Cater | 222/321.7 |
| 7,261,226 | B2 | 8/2007 | Adams et al. | 222/521 |
| D551,077 | S | 9/2007 | Bloc | D9/448 |
| 7,264,724 | B2 | 9/2007 | Vigna et al. | 210/321.75 |
| 7,318,538 | B2 * | 1/2008 | Bichot | 222/82 |
| 7,325,706 | B2 | 2/2008 | Sweeton et al. | 222/382 |
| 7,455,195 | B2 | 11/2008 | Mekata | 222/94 |
| 7,487,891 | B2 | 2/2009 | Yerby et al. | 222/153.13 |
| 7,503,466 | B2 | 3/2009 | Ramet | 2/321.9 |
| 7,520,409 | B2 * | 4/2009 | Bougamont et al. | 222/321.9 |
| 2002/0005412 | A1 | 1/2002 | Laforcade | 222/129 |
| 2002/0082545 | A1 | 6/2002 | Sennett et al. | 604/32 |
| 2002/0148860 | A1 | 10/2002 | Cohen et al. | 222/321.7 |
| 2003/0132247 | A1 | 7/2003 | Hsu et al. | 222/129 |
| 2003/0155375 | A1 | 8/2003 | Da Silva | 222/211 |
| 2004/0047826 | A1 | 3/2004 | Brown | 424/70.12 |
| 2004/0118876 | A1 | 6/2004 | Sweeton et al. | 222/382 |
| 2004/0217133 | A1 | 11/2004 | Ramet | 222/321.9 |
| 2004/0230357 | A1 | 11/2004 | Kobayashi | 701/36 |
| 2005/0072813 | A1 | 4/2005 | Walton et al. | 222/464.3 |
| 2005/0115992 | A1 | 6/2005 | Cohen et al. | 222/383.1 |
| 2005/0133544 | A1 * | 6/2005 | Tadlock et al. | 222/464.2 |
| 2005/0184090 | A1 | 8/2005 | DeJonge | 222/129 |
| 2005/0189380 | A1 | 9/2005 | Sweeton et al. | 222/382 |
| 2005/0189382 | A1 | 9/2005 | Laidler et al. | 222/402.19 |
| 2005/0242123 | A1 | 11/2005 | Finlay et al. | 222/189.1 |
| 2005/0284891 | A1 | 12/2005 | Ramet et al. | 222/321.7 |
| 2006/0043109 | A1 | 3/2006 | Masuda | 222/105 |
| 2006/0054634 | A1 | 3/2006 | Mekata | 222/94 |
| 2006/0237489 | A1 * | 10/2006 | De Lataulade | 222/464.1 |
| 2006/0278661 | A1 | 12/2006 | Cooper et al. | 222/321.1 |
| 2007/0020032 | A1 | 1/2007 | Abbas | 401/188 A |

FOREIGN PATENT DOCUMENTS

| | | |
|---|---|---|
| GB | 2391862 | 2/2004 |
| JP | 2004-067237 | 3/2004 |

OTHER PUBLICATIONS

"Compact pump; new products materials," *Packaging Digest*, 42(2):60, 2005.

"Discreet tube; WRAP up: the latest in packaging innovation," *Global Cosmetic Industry*, 175(9):20(1), 2007.

"Extraction diptubes; new products: equipment," *Packaging Digest*, 43(5):69(1), 2006.

Office Communication issued in Chinese Patent Application No. 200910128402.9, dated Jul. 29, 2011. (English translation).

* cited by examiner

APPARATUS FOR DISPENSING FLUIDS USING A PRESS-FIT DIPTUBE

BACKGROUND

1. Field

The present invention relates generally to systems for delivering fluids, and more particularly to systems for dispensing fluid cosmetic products.

2. Description of Related Art

Fluid products are typically stored within containers. For example, fluid cosmetic products are often stored in bottles and the like. A container may be used in conjunction with a dispensing unit and a diptube to provide controlled dispensing of the contained fluid product.

SUMMARY

Embodiments of the present apparatuses are well suited for use with fluid products. In some embodiments, the present apparatuses include a container having a container body connected to a container mouth, the container being open at the container mouth; and a diptube having a diptube plug. The diptube plug may have a first press-fit surface and a stem connected to the diptube plug, such that the diptube is removably coupled to the container by a press fit between the first press-fit surface of the diptube plug and the container mouth.

Some embodiments of the present apparatuses may include a dispensing unit. The dispensing unit may have a dispenser plug connected to the dispenser body. The dispensing unit may be removably coupled to the diptube.

In some embodiments of the present apparatuses, the diptube plug may include a second press-fit surface. The removable coupling of the dispensing unit to the diptube may be a press fit between the dispenser plug and the second press-fit surface of the diptube plug.

In some embodiments of the present apparatuses, the first press-fit surface of the diptube and the second press-fit surface of the diptube are located such that there can be a line that is normal to the first press-fit surface of the diptube that intersects a portion of the second press-fit surface of the diptube.

Some embodiments of the present apparatuses are designed such that the dispensing unit does not directly contact the container.

In some embodiments of the present apparatuses, the container holds fluid cosmetic products.

Some embodiments of the present apparatuses have a diptube that is fabricated from a plastic material. The plastic material may be polyethylene. In some embodiments of the present actuators, the diptube is a unitary piece.

Some embodiments of the present apparatuses may have a diptube having a snap fit surface, such that the diptube is removably coupled to the container by a snap fit between the snap-fit surface of the diptube plug and the container mouth.

Some embodiments of the present diptube include a diptube plug having a first surface, a second surface, and a stem connected to the diptube plug. The first surface and the second surface may be located such that there can be a line that is normal to the first surface and that intersects a portion of the second surface. The diptube may be capable of being removable coupled to a container by a press fit between the first surface and a portion of the container. The diptube may be capable of being removable coupled to a dispensing unit by a press fit between the second surface and a portion of the dispensing unit.

In some embodiments of the present diptube, there can be a line that is normal to the first surface and to the second surface.

Some embodiments of the present diptube do not have threads suitable for coupling the diptube to other parts, and do not have hooks or recesses suitable for coupling the diptube to other parts via a snap fit.

Any embodiment of any of the present apparatuses and diptubes may consist of or consist essentially of—rather than comprise/include/contain/have—the described elements and/or features. Thus, in any of the claims, the term "consisting of" or "consisting essentially of" may be substituted for any of the open-ended linking verbs recited above, in order to change the scope of a given claim from what it would otherwise be using the open-ended linking verb.

Details associated with the embodiments described above and others are presented below. Other embodiments of the present apparatuses are possible.

BRIEF DESCRIPTION OF THE DRAWINGS

The following drawings illustrate by way of example and not limitation. They are drawn to scale (in terms of proportions). Identical reference numerals do not necessarily indicate an identical structure. Rather, the same reference numeral may be used to indicate a similar feature or a feature with similar functionality. Not every feature of each embodiment is labeled in every figure in which that embodiment appears, in order to keep the figures clear.

DESCRIPTION OF ILLUSTRATIVE EMBODIMENTS

The terms "comprise" (and any form of comprise, such as "comprises" and "comprising"), "have" (and any form of have, such as "has" and "having"), "contain" (and any form of contain, such as "contains" and "containing"), and "include" (and any form of include, such as "includes" and "including") are open-ended linking verbs. As a result, a system or method that "comprises," "has," "contains," or "includes" one or more elements possesses those one or more elements, but is not limited to possessing only those one or more elements or steps. Likewise, an element of a system or method that "comprises," "has," "contains," or "includes" one or more features possesses those one or more features, but is not limited to possessing only those one or more features. Furthermore, a structure that is configured in a certain way must be configured in at least that way, but also may be configured in a way or ways that are not specified.

The terms "a" and "an" are defined as one or more than one unless this disclosure explicitly requires otherwise.

Figure 1:
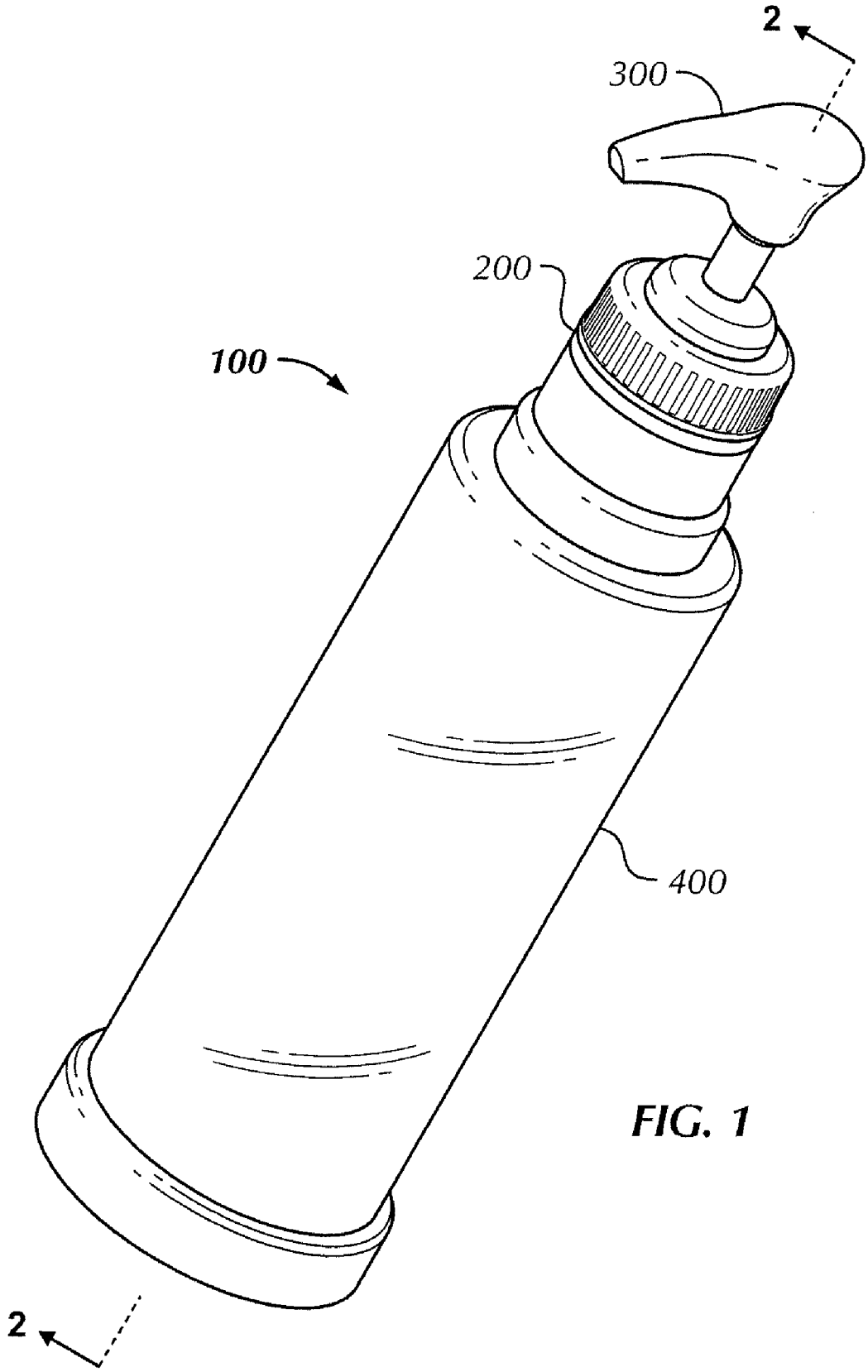
FIG. 1 is a perspective view of one of the present apparatuses that includes embodiments of the present containers, dispensing units, and diptubes.

An example of the present apparatuses appears in perspective in FIG. 1. Apparatus 100 includes diptube 200, dispensing unit 300, and container 400. Some embodiments of apparatus 100 may include only diptube 200 and container 400.

Figure 2A:
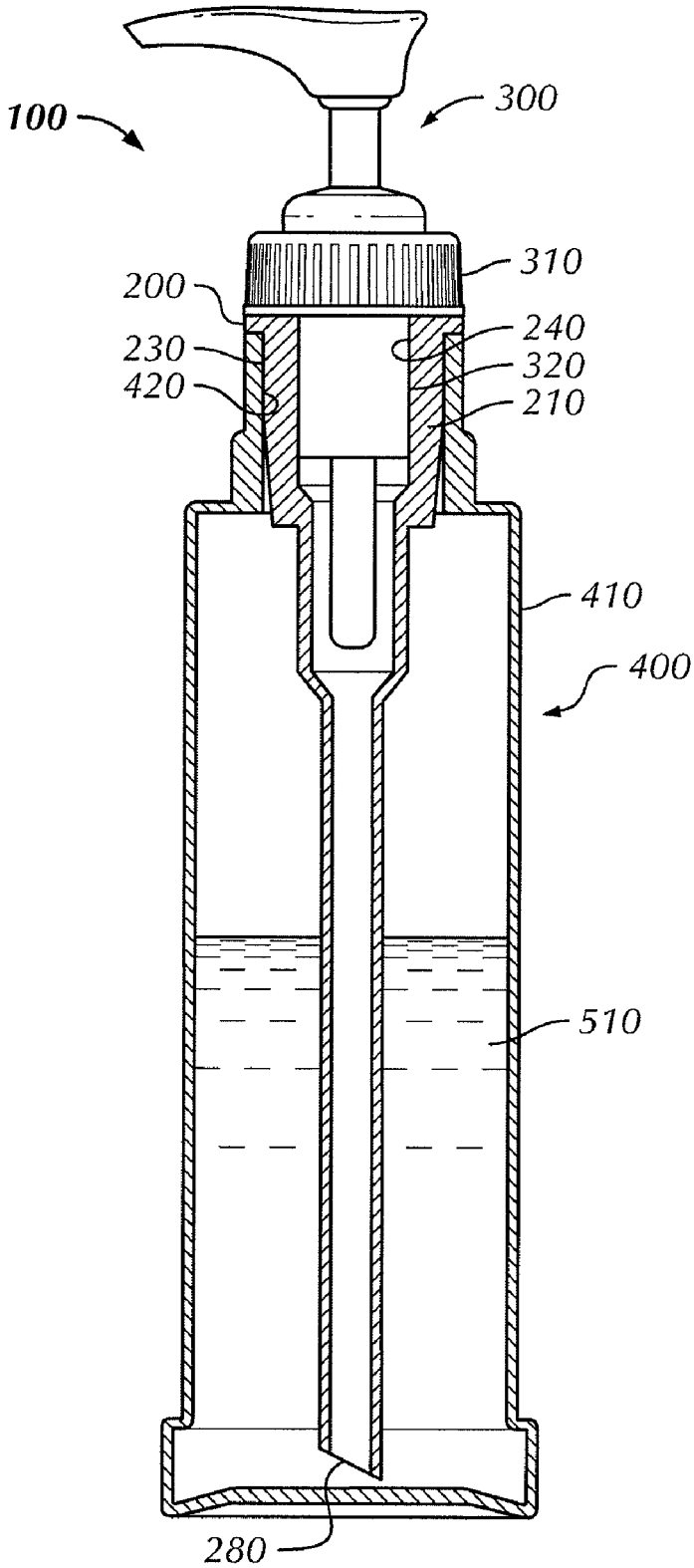
FIG. 2A is a cross-sectional view of the apparatus shown in FIG. 1, taken along plane 2-2 of FIG. 1.
Figure 2B:
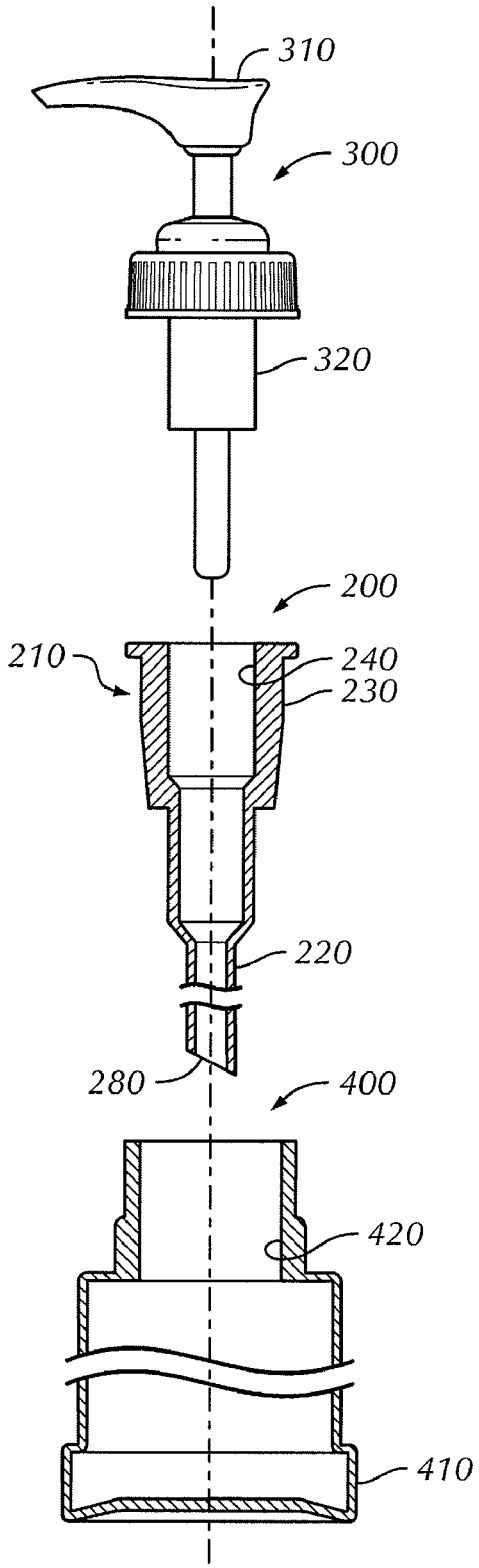
FIG. 2B is an exploded cross-sectional view of the apparatus shown in FIG. 2A.

FIG. 2A is a cross-sectional view of the apparatus shown in FIG. 1. FIG. 2B provides the same view in an exploded cross-sectional format. Container 400 includes container body 410 connected to container mouth 420. Container body 410 may be of rigid construction, or alternately may be designed to be flexible. Container mouth 420 provides an opening though which a portion of diptube 200 may pass.

In some embodiments, container 400 may hold fluid product 510, which may be a fluid cosmetic product. In embodiments where container 400 "holds" fluid product 510, some portion of fluid product 510 is within a volume defined by container 400. In these embodiments, fluid product 510 need not occupy the entire volume defined by container 410, and other materials may concurrently occupy the volume defined by container 410.

Dispensing unit 300 includes dispenser body 310 and dispenser plug 320. Dispensing unit 300 may contain any mechanism suitable for dispensing fluid product 510. For example, dispensing unit 300 may contain a dispensing pump, aerosol spray valve, or dispensing lid. Dispenser plug 320 allows coupling of dispensing unit 300 to diptube 200. The term "coupling" is defined as joining such that there is direct contact between the coupled parts.

Diptube 200 facilitates the dispensing of fluid product 510 from apparatus 100. One of ordinary skill in the art will recognize that fluid contained within container 400 will tend to flow out of container 400 and through diptube 200 if diptube stem end 280 is within fluid product 510 and the pressure within container 400 is greater than the pressure within diptube 200.

Figure 3:
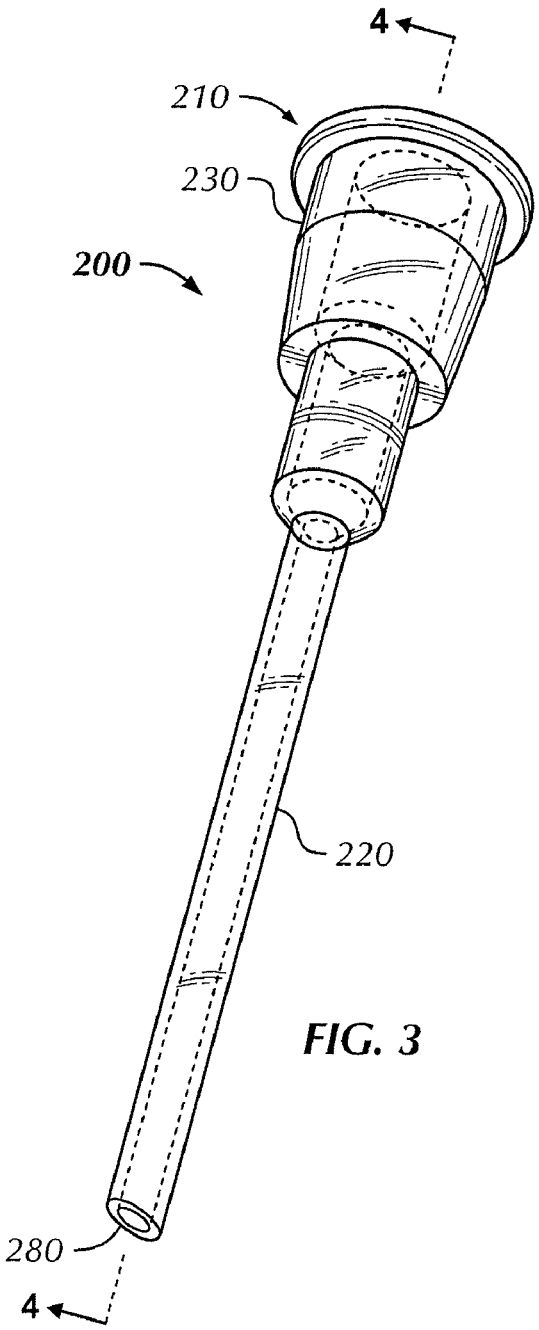
FIG. 3 is a perspective view of one of the present diptubes.
Figure 4:
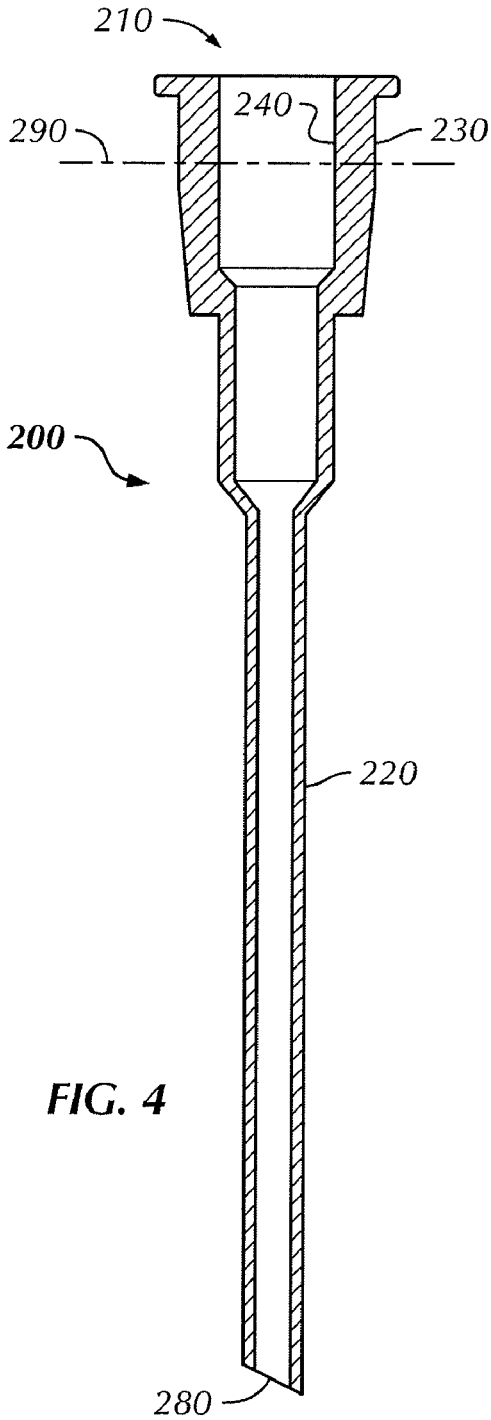
FIG. 4 is a cross-sectional view of the diptube shown in FIG. 3, taken along plane 4-4 of FIG. 3.

Referring to FIGS. 3 and 4, diptube 200 includes diptube plug 210 and stem 220. Preferably, diptube plug 210 and stem 220 are fabricated as a single piece. For example, diptube 200 may be a unitary blow molded or injection molded thermoplastic piece that incorporates diptube plug 210 and stem 220. Preferably, diptube 200 is molded in polyethylene. Alternately, diptube plug 210 and stem 220 may be fabricated as separate pieces and joined to create diptube 200. For example, embodiments of diptube 200 may include plug 210 and stem 220 that have been joined by press-fitting, bonding, welding, or other methods of joining.

Diptube plug 210 may have first press-fit surface 230. Referring to FIGS. 2A and 2B, diptube 200 is coupled to container 400 by a press fit between first press-fit surface 230 and container mouth 420. This coupling is a removable coupling, whereby diptube 200 and container 400 may be coupled, uncoupled, and coupled again via the press-fit between first press-fit surface 230 and container mouth 420.

One of ordinary skill in the art will understand that "press fit" refers to an interference fit, where parts are fastened to each other via frictional forces. Press fits may involve deformation of one or more of the parts being fastened. Press fits do not include connections using mating threads or other similar connections such as quarter-turn fasteners. As used herein, a "press fit" between two objects denotes that the specific objects are involved in the interference fit, and each of the two recited object either deforms or contacts a part of the other object that deforms. Therefore, press-fit surface 230 deforms and/or is in contact with a portion of container mouth 420 that deforms because there is a press fit between press-fit surface 230 and container mouth 420. Likewise, a portion of container mouth 420 deforms and/or contacts a portion of press-fit surface 230 that deforms.

First press-fit surface 230 includes the set of surfaces of diptube plug 210 that (1) are in contact with container mouth 420, and (2) experience deformation and/or are in contact with a portion of container mouth 420 that experiences deformation due to the press-fit coupling of diptube 200 and container 400. First press-fit surface 230 may be a single continuous surface or multiple discrete surfaces of diptube plug 210. The embodiment of diptube plug 210 depicted in FIGS. 3 and 4 includes first press-fit surface 230 having a single continuous surface that is open-ended cylindrical in shape. Other embodiments may include first press-fit surface 230 having multiple discrete surfaces, such as four planar surfaces that form an open-ended box.

Diptube plug 210 may have second press-fit surface 240. Referring to FIGS. 2A and 2B, dispensing unit 300 may be coupled to diptube 200 by a press fit between dispenser plug 320 and first second-fit surface 240. This coupling is a removable coupling, whereby dispensing unit 300 and diptube 200 may be coupled, uncoupled, and coupled again via the press-fit between dispenser plug 320 and first second-fit surface 240.

Second press-fit surface 240 includes the set of surfaces of diptube plug 210 that (1) are in contact with dispenser plug 320, and (2) experience deformation and/or are in contact with a portion of dispenser plug 320 that experiences deformation due to the press-fit coupling of dispensing unit 300 and diptube 200. Second press-fit surface 240 may be a single continuous surface or multiple discrete surfaces of diptube plug 210 The embodiment of diptube plug 210 depicted in FIGS. 3 and 4 includes second press-fit surface 240 having a single continuous surface similar in appearance to the interior surface of an open-ended cylinder. Other embodiments may include second press-fit surface 240 having multiple discrete surfaces, such as four planar surfaces that form the interior of an open-ended box.

Referring to FIG. 4, diptube 200 is preferably designed such that first press-fit surface 230 and second press fit surface 240 are located such that there can be a line 290 that is normal to first press fit surface 230 and that intersects a portion of second press-fit surface 240. In some embodiments of diptube 200, line 290 may be normal to both first press fit surface 230 and second press-fit surface 240. For other embodiments of diptube 200, a line 290 that is normal to first press fit surface 230 that intersects a portion of press-fit surface 240 may not exist.

Figure 5:
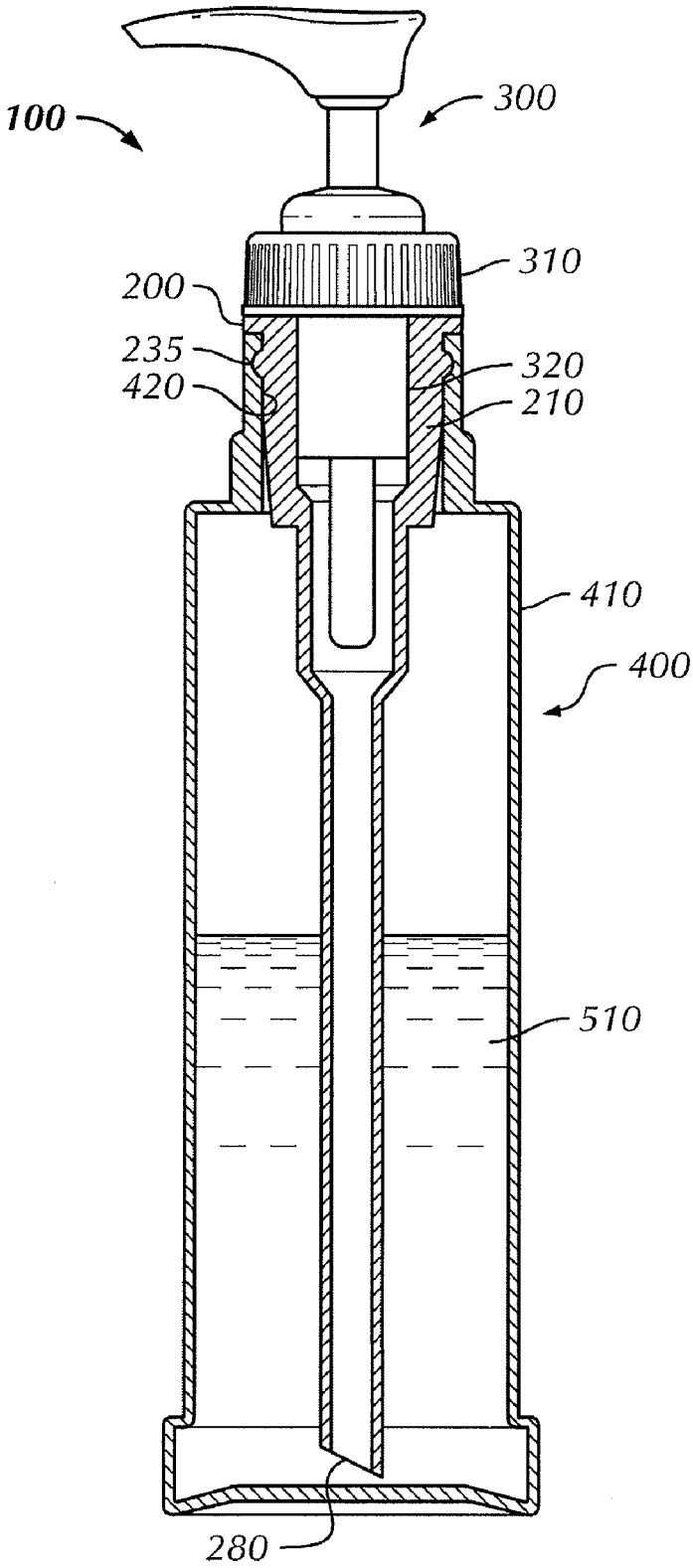
FIG. 5 is a view of an embodiment having a snap fit surface.

FIG. 5 depicts an alternate embodiment of the present apparatuses, where a snap fit involving snap-fit surface 235 is used to removably couple diptube 200 and container 400.

Embodiments of container 400 typically range in size from several inches tall to about one foot tall or more. Typically, container 400 and diptube 200 are fabricated from non-metal materials.

It should be understood that the present apparatuses are not intended to be limited to the particular forms disclosed. Rather, they are to cover all modifications, equivalents, and alternatives falling within the scope of the claims. For example, although the present apparatuses have been described as being well suited for use with fluid cosmetic products, those of ordinary skill in the art will understand that the present apparatuses may be used with many other fluids.

Furthermore, although the components of diptube 200 of the preferred embodiment have been shown as being cylindrically shaped, the components may be of any shape. Additionally, while it is preferable that diptube 200 is molded in polyethylene as a unitary piece, diptube 200 may be fabricated from other materials, and may be the product of joining several discrete pieces.

The claims are not to be interpreted as including means-plus- or step-plus-function limitations, unless such a limitation is explicitly recited in a given claim using the phrase(s) "means for" or "step for," respectively.

What is claimed is:

1. An apparatus for dispensing a fluid comprising:

a container comprising a container body connected to a container mouth, the container being open at the container mouth; and a diptube comprising:

a diptube plug having a first press-fit surface; and a stem connected to the diptube plug;

the diptube being a unitary piece; and a dispensing unit configured to be coupled to the diptube such that the dispensing unit can be actuated to dispense a fluid from the stem;

where the diptube is removably coupled to the container by a press fit between the first press-fit surface of the diptube plug and the container mouth; and where the diptube does not include a valve.

2. The apparatus of claim 1 where the dispensing unit includes a dispenser plug configured to be connected to a dispenser body.

3. The apparatus of claim 2, the diptube plug also including a second press-fit surface, and where the dispensing unit is removably coupled to the diptube by a press fit between the dispenser plug and the second press-fit surface of the diptube plug.

4. The apparatus of claim 3, the first press-fit surface and the second press-fit surface being located such that there can be a line that is normal to the first press-fit surface and that intersects a portion of the second press-fit surface.

5. The apparatus of claim 4, where the dispensing unit does not directly contact the container.

6. The apparatus of claim 4, the diptube being fabricated from a plastic material.

7. The apparatus of claim 6, the plastic material being polyethylene.

8. The apparatus of claim 7, where the dispensing unit does not directly contact the container.

9. The apparatus of claim 8, where the container holds a fluid cosmetic product.

10. The apparatus of claim 1, the diptube being fabricated from a plastic material.

11. The apparatus of claim 10, the plastic material being polyethylene.

12. The apparatus of claim 1, where the container holds a fluid cosmetic product.

13. A diptube comprising:

a diptube plug having a first surface and a second surface located such that there can be a line that is normal to the first surface and that intersects a portion of the second surface; and a stem connected to the diptube plug; where:

the diptube is capable of being removably coupled to a container by a press fit between the first surface and a portion of the container; and the diptube is capable of being removably coupled to a dispensing unit by a press fit between the second surface and a portion of the dispensing unit;

a dispensing unit configured to be coupled to the diptube such that the dispensing unit can be actuated to dispense a fluid from the stem;

the diptube being a unitary piece; and where the diptube does not include a valve.

14. The diptube of claim 13, where there can be a line that is normal to the first surface and to the second surface.

15. The diptube of claim 14, where the diptube does not have threads suitable for coupling the diptube to other parts, and the diptube does not have hooks or recesses suitable for coupling the diptube to other parts via a snap fit.

16. The diptube of claim 15, the diptube being fabricated from a plastic material.

17. The diptube of claim 16, the plastic material being polyethylene.

18. An apparatus for dispensing a fluid comprising:

a container comprising a container body connected to a container mouth, the container being open at the container mouth; and a diptube comprising:

a diptube plug having a snap-fit surface; and a stem connected to the diptube plug;

the diptube being a unitary piece;

a dispensing unit configured to be coupled to the diptube such that the dispensing unit can be actuated to dispense a fluid from the stem;

where the diptube is removably coupled to the container by a snap fit between the snap-fit surface of the diptube plug and the container mouth; and where the diptube does not include a valve.

19. The diptube of claim 18, the diptube being fabricated from a plastic material.

* * * * *

UNITED STATES PATENT AND TRADEMARK OFFICE

CERTIFICATE OF CORRECTION

PATENT NO. : 8,376,192 B2
APPLICATION NO. : 12/054108
DATED : February 19, 2013
INVENTOR(S) : Tim Maddy It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 920 days.

Signed and Sealed this
Twenty-eighth Day of October, 2014

Michelle K. Lee

Michelle K. Lee
*Deputy Director of the United States Patent and Trademark Office*